US005879465A

United States Patent [19]

McKevitt et al.

[11] Patent Number: 5,879,465

[45] Date of Patent: Mar. 9, 1999

[54] METHOD AND APPARATUS FOR DESCALING HOT ROLLED STAINLESS STEEL STRIP

[76] Inventors: Patrick McKevitt, 740 Perry Hwy., Harmony, Pa. 16509; Stanley E. Lapek, 125 Dillon St., Beaver Falls, Pa. 15010

[21] Appl. No.: 770,424

[22] Filed: Dec. 20, 1996

[51] Int. Cl.[6] ..... C23G 1/02

[52] U.S. Cl. ..... 134/3; 134/15; 134/41; 72/40; 29/81.03; 29/81.12

[58] Field of Search ..... 134/9, 15, 28, 134/41, 2, 3; 29/81.03, 81.12; 72/39, 40

[56] References Cited

U.S. PATENT DOCUMENTS

| | | | |
|---|---|---|---|
| 4,078,949 | 3/1978 | Boggs et al. . | |
| 4,406,761 | 9/1983 | Shimogori et al. . | |
| 4,872,245 | 10/1989 | Kawasaki et al. . | |
| 4,996,998 | 3/1991 | Seiz et al. . | |
| 5,108,544 | 4/1992 | Hakansson . | |
| 5,131,126 | 7/1992 | Katsuki et al. . | |
| 5,197,179 | 3/1993 | Sendzimir et al. | 29/527.4 |
| 5,354,383 | 10/1994 | Bianchi . | |
| 5,412,966 | 5/1995 | Neese et al. . | |
| 5,702,534 | 12/1997 | Rodabaugh et al. | 134/7 |

FOREIGN PATENT DOCUMENTS 2-20610 1/1990 Japan .

*Primary Examiner*—Jeffrey Stucker

*Attorney, Agent, or Firm*—Sixbey, Friedman, Leedom & Ferguson, PC; Stuart J. Friedman

[57] ABSTRACT

A method and apparatus for removing oxide scale from the surface of hot-rolled stainless steel strip comprises uncoiling the steel strip coil, removing the coil bias and cracking the surface scale in a first scalebreaking apparatus, flattening the strip by removing edge wave and center buckle to a flatness approaching table top flat, the tolerable deviation therefrom depending upon the gauge of the strip, pre-cleaning the strip, pickling the strip in a series of turbulent flow pickle tanks using a dilute acid, such as hydrochloric acid, desirably in the presence of an acid accelerator, rinsing the pickled strip with water, vigorously brushing the pickled strip for removing adherent alloying element oxide films not removable by dilute acid pickling, drying the pickled strip, inspecting the strip, electrostatically oiling the strip and recoiling the strip. Desirably, the strip is flattened in a two high temper mill which, at the same time, elongates the strip, reduces its gauge and further cracks the surface scale.

40 Claims, 15 Drawing Sheets

METHOD AND APPARATUS FOR DESCALING HOT ROLLED STAINLESS STEEL STRIP

FIELD OF THE INVENTION

The present invention relates generally to descaling steel strip and, more particularly, to methods and apparatus for descaling hot-rolled stainless steel strip.

BACKGROUND OF THE INVENTION

The presence of oxide (scale) on the surface of steel strip, sheet, or breakdowns is objectionable when such materials are to be further processed. For example, the oxide must be removed and a clean surface provided if satisfactory results are to be obtained from the hot-rolled sheet or strip in any operation involving deformation of the material. If the sheet is for drawing applications, removal of the oxide is essential, and its presence on the steel surface tends to shorten die life, cause irregular drawing conditions and destroy surface smoothness of the finished product. Oxide removal is also necessary to permit proper alloying or adherence of metallic coatings and satisfactory adherence when a non-metallic coating or paint is used. Moreover, in the production of cold-reduced steel sheet and strip, it is necessary that the oxide resulting from hot rolling the steel slab to breakdown form be completely removed before cold reduction to prevent lack of uniformity and eliminate surface irregularities.

The term "oxide" as used herein, unless otherwise stated, refers generally to the chemical compounds of iron and oxygen, as well as the chemical compounds of iron alloying elements, e.g., chromium, and oxygen, formed on the surface of the steel by exposure to air while the metal is at an elevated temperature. "Scale" is specifically the oxidized surface of steel produced during hot working of steel. Hence, the oxide produced on steel surfaces in hot-rolling processes is known as mill scale. Chemical compounds thus formed include iron oxides, such as FeO, $Fe_2O_3$ and $Fe_3O_4$, chromium oxides, and the like.

Pickling is the process of chemically removing oxides and scale from the surface of a metal by the action of water solutions of inorganic acids. Considerable variation in type of pickling solution, operation and equipment is found in the industry. Among the types of pickling equipment may be mentioned the batch picklers, modified batch, non-or semi-continuous and continuous picklers.

The reaction occurring when steel or iron materials are immersed in dilute inorganic acid solutions includes the solution of metal as a salt of the acid and the evolution of hydrogen. Steel pickled in dilute hydrochloric acid and sulfuric-acid solutions is an example of this reaction, with the end products of reaction being, respectively, ferrous chloride and hydrogen and ferrous sulfate and hydrogen. Adherent films of oxides are undermined by the acid attack upon the scale on the base metal.

The rate of pickling is affected by numerous variables, including the steel-based constituents and type and adherence of oxide to be removed. Solution temperature and concentration, reaction product concentration, agitation, time of immersion and presence or absence of inhibitors and accelerators influence the rate of acid attack. Because of factors including pickling speed and efficiency, as well as reduced attack on the base metal, hydrochloric acid has effectively displaced sulfuric acid as the acid of choice in industrial pickling of carbon steel and other conventional, non-stainless, steels. While the rate of pickling increases in direct proportion to the concentration of the acid, the influence of temperature is much more pronounced. For example, in 15 per cent sulfuric acid an increase in temperature over the range 70° F. to 210° F. doubles the pickling rate for each rise of 15° or 20° F. in temperature. Rate of solution of iron at 180° F. is about five times the rate at room temperature. Certain metals, such as copper, chromium and nickel, retard the rate of pickling when they occur in the steel base, since the scale bearing these alloying metals inhibits acid attack. Silicon and aluminum, for example, form refractory-type oxides, which in turn lower the solubility rate of the oxide in the acid.

With the advent of continuous cold-reduction mills, it was necessary to design and develop suitable equipment to remove the oxides resulting from the continuous hot-rolling operation and prepare the hot-rolled breakdowns for cold reduction in coil form. This operation is typically performed in either a continuous or semi-continuous (push-pull) pickling line. The primary function of a continuous and semi-continuous pickling line, as with other pickling processes, is the removal of oxide from the steel surface. This serves to promote maximum cold reduction with a minimum of power to assure good roll life in the cold-reduction mills within which the strip will be later processed and to secure the increased surface density possible with cold work. The primary differences between a continuous pickle line and a non-or semi-continuous pickle line is that in a continuous line the tail of one coil is welded to the head of the next coil so that the strip is always in tension. In addition, continuous pickle lines generally require looping pits for providing strip storage space when brief delays arise at the strip charging end and for permitting a uniform rate of travel through the pickling tanks. An advantage of semi-continuous picklers is that they readily accommodate coil-to-coil changes in strip width and gauge with minimal down time.

The thickness of the oxide varies considerably on steel rolled on the hot-strip mill. For example, loose coiling permits greater atmospheric penetration into the wraps, with corresponding heavier oxide formation on the edge areas. In addition, coiling temperature affects the adherence of the oxide and determines, in part, how easy or difficult it is to remove. Typically, hot coiling within a prescribed temperature window, e.g., 1150°–1300° F., makes oxide removal easier.

Conventional non-continuous and continuous pickling lines for carbon steel and other conventional non-stainless steels generally include the steps of uncoiling the steel strip coil, semi-flattening the strip in a processor comprising a series of five rolls, generally having diameters of 8–12 inches, to remove the coil set and to crack the surface scale at the strip edges, passing the strip through a secondary scalebreaker which may, for example, be a two-high temper mill to further scalebreak while, at the same time, reducing gauge thickness and elongating the strip, pre-cleaning the strip in a hot water or mild caustic spray, pickling the strip in a series of turbulent flow pickle tanks using dilute acid such as hydrochloric acid or sulfuric acid and an acid inhibitor to prevent base metal attack by the dilute acid after scale removal, rinsing the pickled strip with water, drying the pickled strip, inspecting the strip, electrostatically oiling the strip and recoiling the strip.

More specifically, at the coil entry end of a typical semi-continuous or a continuous pickling line for removing the oxide scale from hot rolled carbon steel strip, such as is disclosed in U.S. Pat. No. 5,354,383 -Bianchi, which discloses a semi-continuous pickling line, are facilities for handling and charging coiled product into the line. These usually consist of conveyors on which the coils are placed in proper sequence by overhead cranes, upenders in cases where the coil is delivered with the axis vertical, and a motor-driven integrated buggy and hoist for placing the coil in the uncoiling or pay-off equipment. The primary cold-working equipment, integral with the uncoiling equipment, consists of a mandrel on which the coil is placed, a hold-down roll, and a series of smaller diameter (about 8–12 inches) rolls. After the coil is charged on the mandrel and the lead-end entered into the small diameter rolls, the hold-down roll is brought down and pressure applied to the material. This action alternatively flexes the steel around the smaller diameter rolls, thus somewhat "breaking" the surface scale into numerous fine cracks, particularly at the strip edges, and increasing somewhat the available sub-oxide area for pickling acid attack. This flexing also cold works the steel enough to eliminate, in large part, the fluting (formation of creases when the steel is bent or otherwise deformed) tendencies of the hot-rolled steel. The group of small driven rolls immediately following the hold-down or breaker roll applies tension to the steel and also serves to sufficiently straighten it to remove the coil set. A stationary shear is located after the processor for the cropping and squaring of the coil ends.

In some pickling lines, an auxiliary or secondary scale-breaker is provided to break the scale even further than was achieved in the processor at the entry end, and thus increase the speed at which the line can be operated and still produce satisfactorily pickled strip. The secondary scalebreaker may be a roller-type machine, or it may be a two-high temper mill preceded and followed by a tension bridle at the entry and exit sides of the mill. Use of a two-high temper mill, for example, may result in extension of the strip on the order of 3 per cent and an increase in hardness of 3 to 5 points on the Rockwell B scale.

The pickling zone usually consists of several individual acid-proof tanks located in series, comprising an effective immersion length of about 150 to 300 feet. While many lines have from three to five tanks, each about 40 to 80 feet long, some lines have only one long tank, divided by weirs into four or five sections. The strip is completely submerged under several inches of liquid acid bath as it travels through the tank or series of tanks forming the pickling zone. Automatic acid controls are available which monitor the HCl content in one or more tank sections of the line and automatically add acid to maintain a preset concentration. In a typical line the acid is added in the third and fourth tank sections. The pickling solution then cascades over the top of the strip and flows counter to the direction of strip travel through shallow channels cut in the weirs between tank sections. The tanks are either of the shallow-bath type (about 15 inches in depth) or of the more traditional type (about four feet in depth and weir heights are decreased about an inch per weir from the exit to the entry ends of the tanks). In a typical four tank line, weir heights would be on the order of 40, 39 and 38 inches in height from the exit to the entry end of the pickling tanks.

In hot-rolling operations, the steel strip is usually water cooled after hot-rolling by exposing the top surface of the strip to a stream or spray of water. The cooling water tends to pool on the top surface of the strip, thereby cooling the top surface at a faster rate than the bottom surface. Since the rate of oxidation of steel is a proportional function of both time and temperature, scale formation is virtually always thicker on the bottom surface of the hot-rolled strip. To deal with this, conventional pickling tanks inject the acid from the bottom of the tanks and direct the acid upwardly toward the bottom side of the strip to enhance the acid attack on the relatively thicker scale at the strip bottom surface. The thinner and less developed oxide films at the strip top surface are pickled at the same rate as the bottom surface scale by the turbulence normally accompanying a strip travelling through a pickling bath.

Following the acid tanks in a conventional pickle line are rinsing tanks consisting of cold-water spray rinse and, occasionally, a hot-water tank. The cold water rinses the carry-over acid from the strip. The hot water rinse is a tank with an effective product immersion length of 15 to 20 feet. This tank completes the rinsing and by warming the steel, promotes flash drying prior to entering the succeeding set of pinch rolls. Situated between the final rinse tank and the pinch rolls are one, two or three banks of hot-air dryers operating at low pressures. Pinch rolls at the exit end of the pickling tanks control the speed of product travel and, in conjunction with the pinch rolls which provide back tension at the entry end of the line, help to maintain the proper loops in the tanks.

The delivery or exit end of the pickling line commonly has, in the order listed, a looping pit, pinch rolls, shear, oiler, recoiler and suitable supplementary equipment for conveying the finished product from the line. The pinch rolls preceding the shear are located so that product delivery to the shear is facilitated. Stitches, if present, are removed at this point, as well as short sections which inspection has shown to be of inferior quality. Some lines are provided also with rotary side trimmers at the entry end or, more commonly, at the delivery end.

Inspection of the raw pickled product, by simultaneous inspection of both surfaces of the strip using a battery of lights and one or more mirrors, is carried on continuously at the exit end of the pickling lines. Each coil is inspected for surface and edge quality, width and gauge. Some of the defects commonly causing rejection or diversion are slivers, cracked edges, laminations, off-gauge, off-width, roll marks, underpickling, overpickling, handling damage and pitting.

Underpickling results when the steel has not had sufficient time in the pickling tanks to become free of adherent scale and occurs when acid concentration, solution temperatures and line speed are not balanced properly. Variations in the oxide and composition of the steel are also factors in underpickled product, as well as such factors as coiling temperature of the hot-strip mill and inadequate amount of cold working through the processor. Overpickling results from the line delays which permit sections of the steel to remain in the acid too long. The presence of an inhibitor during conventional carbon steel pickling is essential to reduce iron loss. When an inhibitor is not used, iron loss during a short delay period appreciably reduces thickness of the carbon steel and raises the hazard of hydrogen embrittlement. Pitting is related to overpickling, the presence of nonmetallic inclusions near the steel surface and to rolled-in scale, slag or a refractory substance. While overpickling is not common in continuous or semi-continuous pickling operations, its occurrence does have a very serious effect on cold-reduction performance and surface appearance of the finished product. Furthermore, product damage from handling or improper equipment adjustment can render the steel unsuitable for further processing.

Prior to recoiling, the pickled steel passes between a set of oiling rolls which cover both surfaces with a small amount of oil. The type of oil used to lubricate the steel, and protect it from rusting during storage and from scratching during handling, is determined by the type of lubricating system on the cold-reduction mill unit. Hence, palm oil diluted with light mineral oil, is applied to the steel at the pickling line when a straight palm oil or a solution containing palm oil is used on the cold-reduction mill in which the strip is to be subsequently processed. Finally, the pickled and oiled product is recoiled on a conventional up-type or down-type coiler.

Like carbon steel, stainless steels also oxidize following hot rolling and coiling. However, because stainless steels are highly alloyed with such metals as chromium, manganese, silicon, and the like, the oxide layer formed on the surface of the hot rolled strip has a different chemical composition than the predominantly iron oxide film which forms on carbon steel strip. Moreover, it is well known that the oxide film formed on high chromium-containing stainless steel strip is very tightly adhering, which makes the descaling or pickling of such stainless steels very difficult as compared to carbon steels and the more conventional non-stainless steels. To achieve efficient and thorough surface oxide removal from such stainless steels, more severe processing techniques must be used which substantially increase processing time and operational costs. Frequently, to effect complete oxide scale removal, chemical pickling of stainless steel strip must be preceded by mechanical descaling, e.g., by shotblasting, which has the disadvantage that the strip surface is damaged by the shotblasting.

The pickling process most commonly used for stainless steel involves the use of a mixture of nitric acid and hydrofluoric acid, the mutual concentrations of which vary according to the type of plant, the type of steel to be pickled, its surface characteristics and its past processing history. Although the process enables excellent results to be obtained, it has the very serious drawback that it creates considerable and substantial ecological problems due to the use of these particular acids. In this respect hydrofluoric acid is extremely corrosive and a harmful environmental pollutant. Nitric acid is the source of highly polluting nitrogen oxide ($NO_x$) vapors which are emitted into the atmosphere and which are highly aggressive towards metals and non-metals with which they come into contact. In addition, high nitrate levels exist in the wash water and in the spent baths and create a major disposal problem. The elimination of $NO_x$ vapors in the air and nitrates in the spent baths creates considerable plant operational problems, very high operational costs and no certainty that the solutions to these ecological problems will satisfy current government limitations and regulations. In the final analysis, the cost of building and operating nitric acid/hydrofluoric acid pickling plants for hot rolled stainless steel strip in an ecological safe and economic manner is highly problematic.

As a result there has been considerable interest in developing stainless steel pickling processes and plants which do not use either nitric acid or hydrofluoric acid and which are ecologically safe. U.S. Pat. No. 5,354,383 outlines a number of nitric acid-free processes which have been proposed as an alternative to the traditional stainless steel pickling process based on these acids. However, to date, no ecologically acceptable, commercially practical and economic alternative has yet been found and there is a continuing need for such a process.

SUMMARY OF THE INVENTION

It is, therefore, an object of the present invention to provide a descaling method and apparatus for removing oxides from the surface of hot-rolled stainless steel strip which does not utilize either nitric acid or hydrofluoric acid as the pickling acid.

It is another object of the present invention to provide a descaling method and apparatus for removing oxides from the surface of hot-rolled stainless steel strip which does not employ surface damaging mechanical descaling techniques.

It is still another object of the present invention to provide a descaling method and apparatus for removing oxides from the surface of hot-rolled stainless steel strip which is ecologically safe.

It is yet another object of the present invention to provide a descaling method and apparatus for removing oxides from the surface of hot-rolled stainless steel strip which permits utilization of existing carbon steel pickling plants.

It is an important object of the present invention to provide a descaling method and apparatus for removing oxides from the surface of hot-rolled stainless steel strip which utilizes conventional hydrochloric acid pickling.

It is another important object of the present invention to provide a descaling method and apparatus for removing oxide scale from the surface of hot-rolled stainless steel strip which utilizes vigorous brushing subsequent to hydrochloric acid pickling for removing adherent alloying element oxide films not removable by hydrochloric acid pickling.

The foregoing and other objects can be accomplished by providing a method of removing oxide scale from the surface of hot-rolled stainless steel strip comprising uncoiling the stainless steel strip from a coil of the strip, flattening the strip sufficiently, depending upon the gauge of the strip, to permit mechanical descaling means to uniformly contact the surfaces of the strip, pickling the flattened strip in an acid solution to remove oxide scale from the surfaces, mechanically abrading the oxide scale remaining on the strip surfaces following acid pickling to remove the scale, and recoiling the strip. Desirably, the flattening step involves controllably elongating the strip, controllably reducing the strip gauge, substantially removing edge wave and center buckle and breaking the oxide scale on the surface of the strip to increase the surface area thereof available for acid pickling attack. Preferably, the mechanical descaling step is accomplished using grinding brush rolls for vigorously brushing oxide scale from the strip surface.

In another embodiment of the invention these and other objects are achieved by providing a pickle line operable to remove oxide scale from the surface of hot-rolled stainless steel strip comprising means for uncoiling stainless steel strip from a coil of strip, means for controllably flattening the strip sufficiently, depending upon the gauge of the strip, to permit mechanical descaling means to uniformly contact the surfaces of the strip, means for pickling the flattened strip in an acid solution to remove oxide scale from the surfaces thereof, mechanical descaling means for removing the oxide scale remaining on the strip surfaces following acid pickling, and means for recoiling the strip. Desirably, the means for controllably flattening the strip comprises temper mill means positioned between the uncoiling means and the pickling means for controllably flattening the strip by substantially removing edge wave and center buckle, controllably reducing strip gauge and for breaking the oxide scale on the strip surface.

In a preferred embodiment the mechanical descaling means comprises brushing means for abrading the oxide scale from the strip surface. The brushing means includes at least two grinding brush roll assemblies arranged in series along the direction of strip travel, each assembly including a grinding brush roll and at least one backing roll opposing each other on opposite surfaces of the strip, the grinding brush roll being positioned alternately above and below the strip in adjacent assemblies and adapted to rotate in the direction counter to the direction of travel of the strip. Desirably, the brushing means includes means for rinsing the abraded scale from the grinding brush rolls and the strip.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 1:
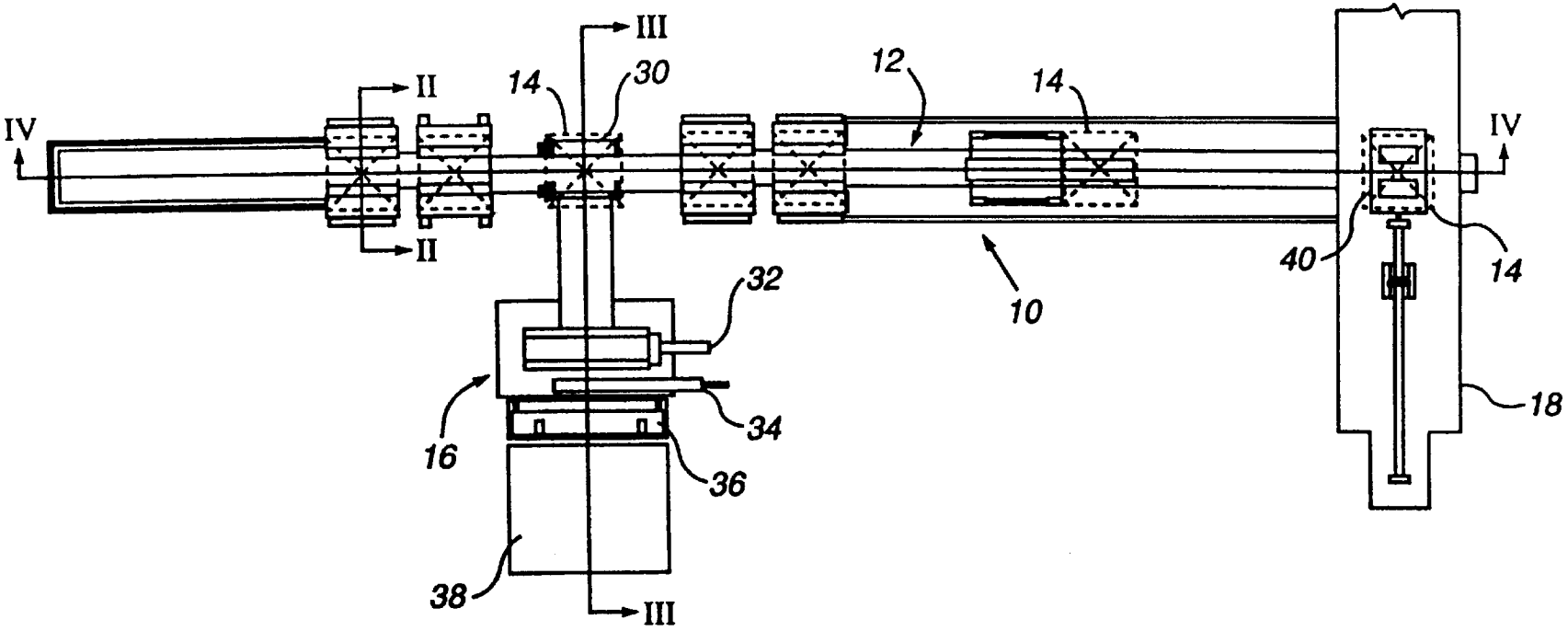
FIG. 1 is a plan view of the coil entry portion of a pickle line constructed in accordance with the present invention.
Figure 4:
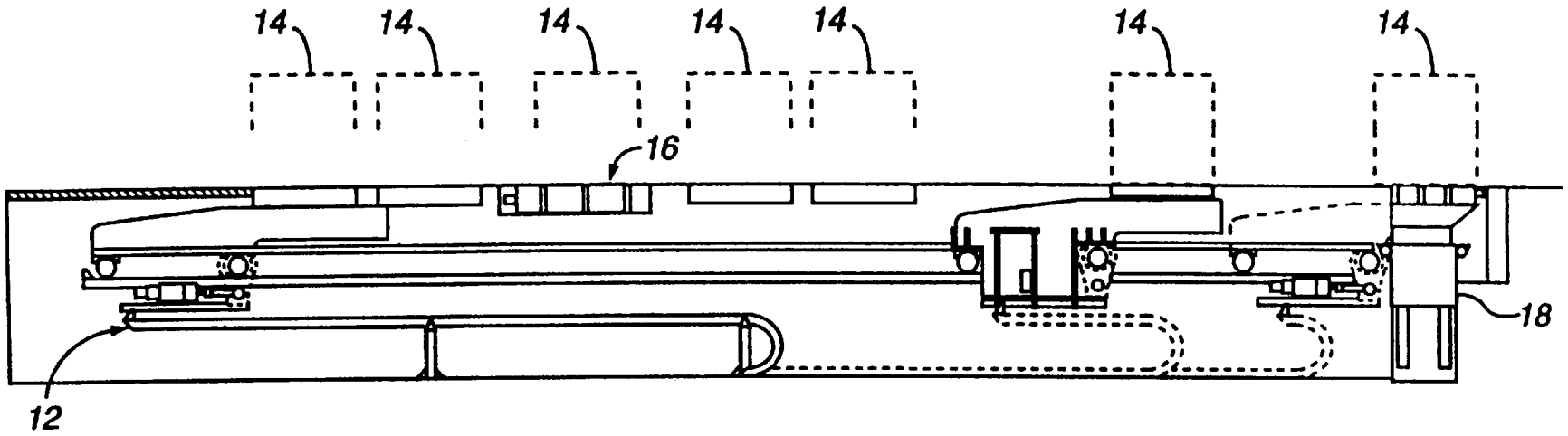
FIG. 4 is a sectional view of the coil entry portion taken along line IV—IV of FIG. 1.

There is generally indicated at 10 in FIGS. 1 and 4 a coil entry portion of a steel strip pickling line constructed according to a presently preferred embodiment of the instant invention. In this preferred embodiment the described pickle line is a semi-continuous, push-pull line although, it will be appreciated, the present invention may be utilized with conventional continuous pickle lines as well.

Figure 2:
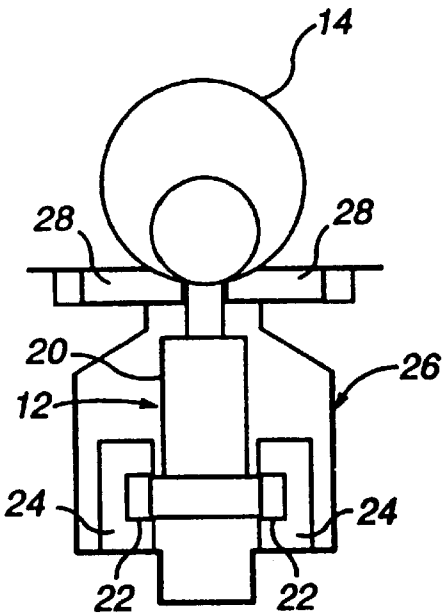
FIG. 2 is sectional view of the coil entry portion taken along line II—II of FIG. 1.

Coil entry portion 10 includes a first conveyor 12 for transporting hot-rolled strip coils 14 to a coil preparation station 16 and to a coil car system 18. The coil car system operates to move coils 14 from the first conveyor 12 to an uncoiler station of a later-described strip treatment portion of the pickle line. As is most clearly depicted in FIGS. 2 and 4, the first conveyor 12 comprises a motorized, reciprocable carriage 20 rollingly supported at opposite sides thereof by wheels 22 which travel in spaced, parallel rails 24 provided in a subterranean conveyor passageway 26. Situated atop the carriage 20 is a pair of coil saddles 28 by which the carriage supports the coils during transport. Upon loading of a coil 14 on saddles 28, the coil is first delivered by carriage 20 to the coil preparation station 16.

Figure 3:
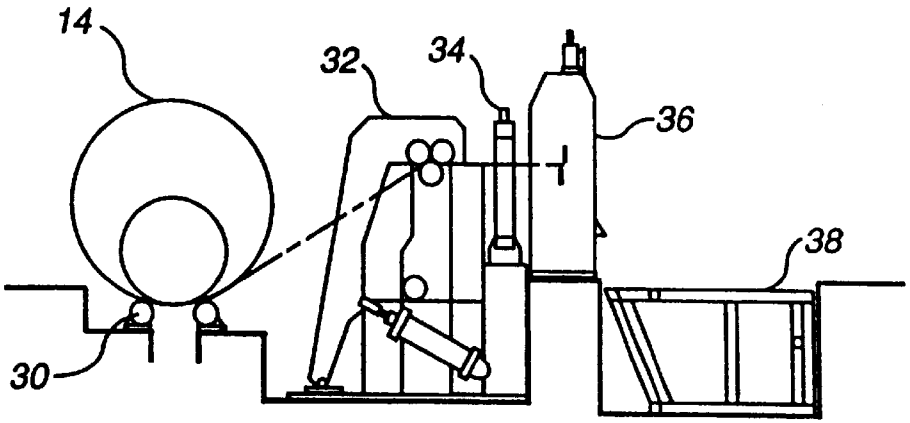
FIG. 3 is a sectional view of the coil entry portion taken along line III—III of FIG. 1.
Figure 5A:
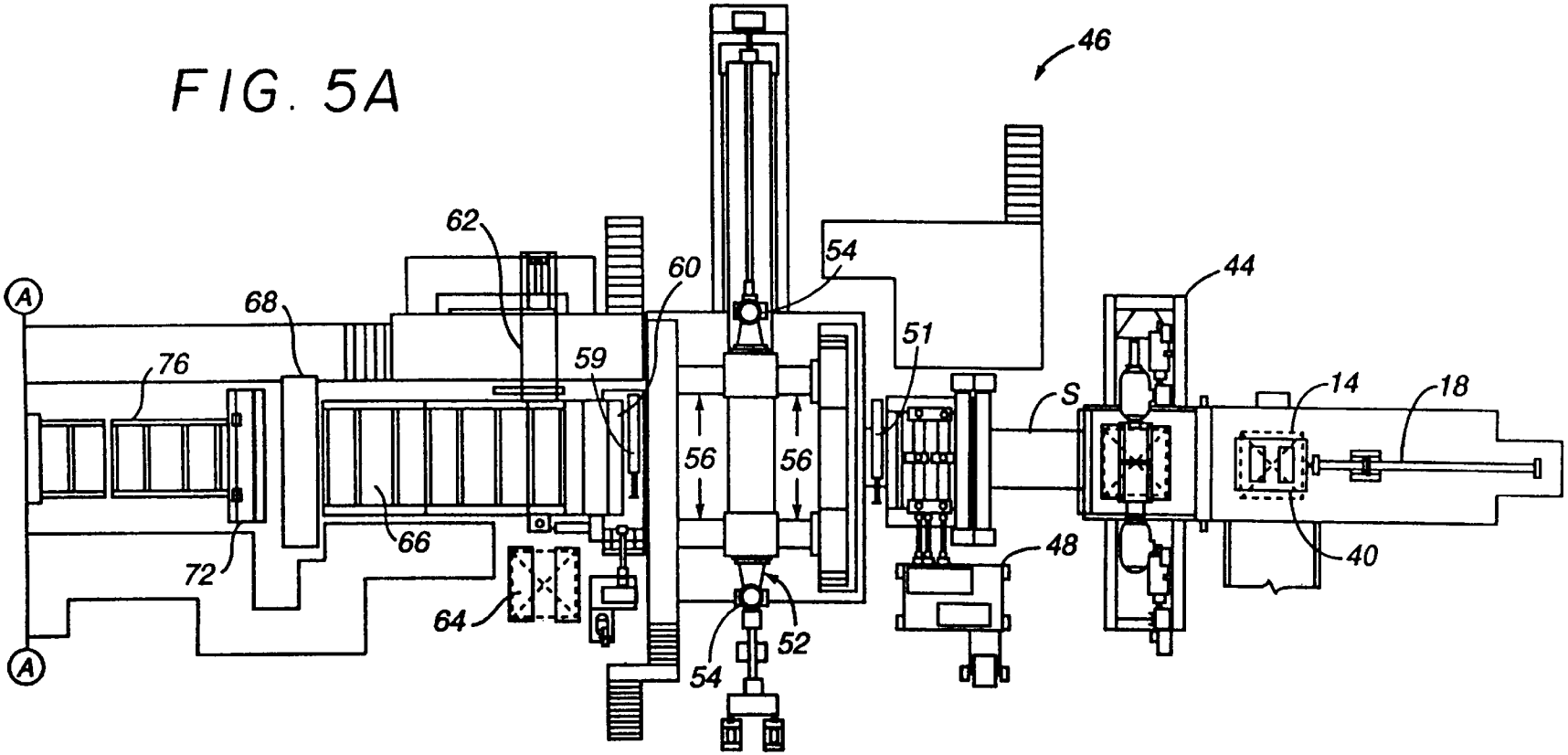
FIGS. 5A, 5B, 5C, 5D and 5E are serial plan views of the strip treatment portion of a pickle line constructed according to the present invention.
Figure 6E:
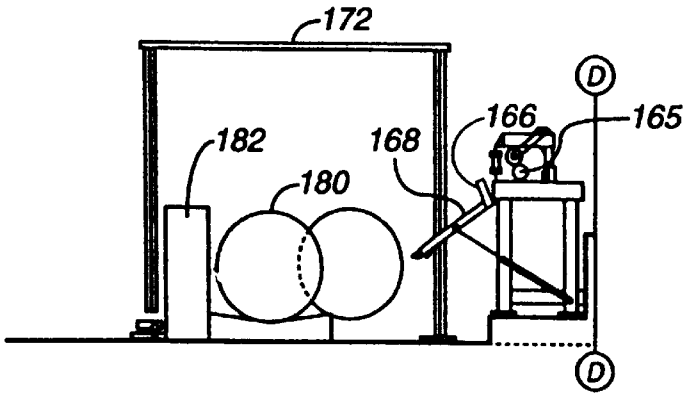
FIGS. 6A, 6B, 6C, 6D and 6E are serial elevation views corresponding to FIGS. 5A through 5E of the centerline of the strip treatment portion.
Figure 6A:
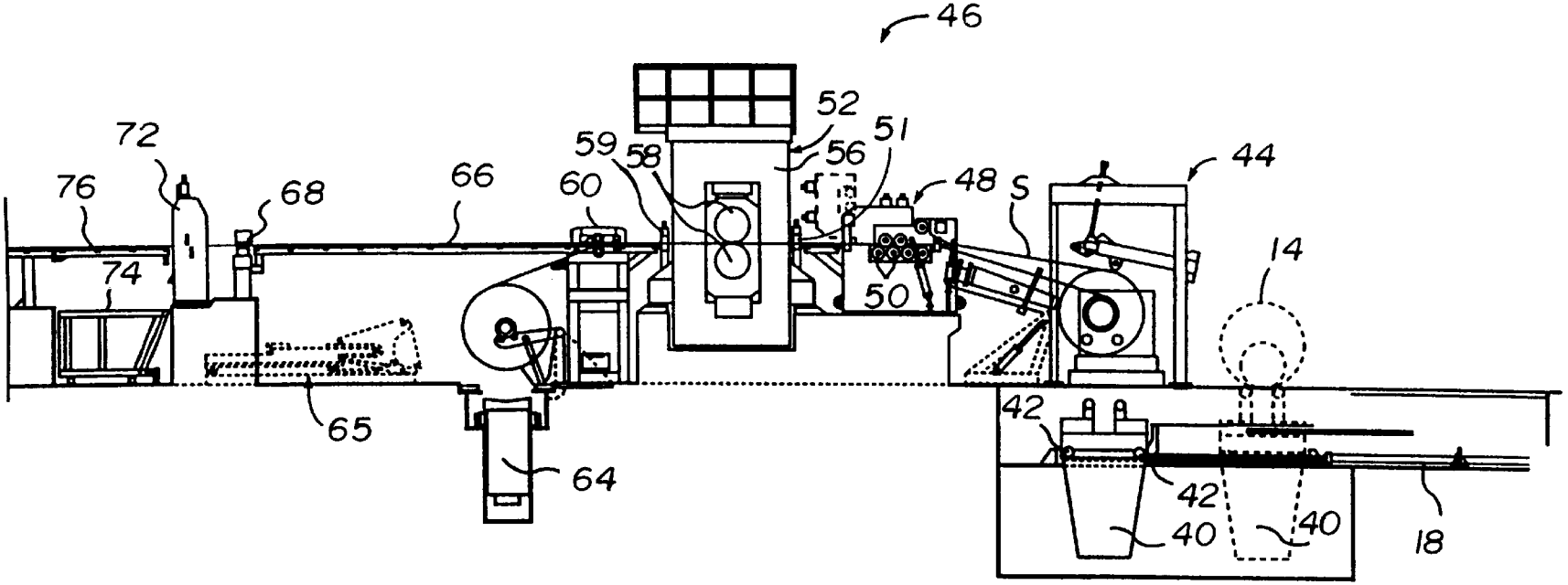

The coil preparation station, as shown in FIGS. 1 and 3, includes a blocker roll 30, a coil set removal unit 32, x-ray or equivalent monitoring equipment 34 for examining steel characteristics such as gauge, surface quality, and the like, a crop shear 36 and a scrap box 38. Along with thickness measurement, the coil preparation station, by virtue of the crop shear 36, enables cutting of the strip to an approximate preliminary length as well as squaring of the leading strip end to facilitate its passage through the downstream strip treatment equipment. Any excess steel cut by the crop shear is deposited in the scrap box 38. Once adequately prepared, the lead end of the strip is temporarily secured to the coil whereupon the coil is delivered by the carriage 20 to an entry uncoiler car 40 (FIGS. 5A and 6A). Generally, the dimensions of steel strip subjected to processing by the pickle line of the instant invention will range in gauge from about 0.060 to about 0.500 inches in thickness and about 48 to about 72 inches in width, although strip of somewhat greater or lesser gauge and/or width may be successfully processed.

The entry uncoiler car 40 is mounted on wheels 42 and travels transversely to the first conveyor 12. The coil car system 18 engages the entry uncoiler car 40 and moves the car to an entry uncoiler 44, the initial component of a strip treatment portion 46 of the steel strip pickling line. As is common, the uncoiler 44 is a motor driven mechanism including a payoff snubber and breaker roll by which the leading strip end is unwound from the coil 14 and charged into a coil peeler or processor 48. The processor is also a motorized device and comprises a series of small diameter (about 8–12 inches) driven rolls 50 (FIG. 6A) situated both above and beneath the strip and between which the strip (which is designated by the letter "S") passes. Although the axes of rotation of the upper and lower rolls 50 are parallel to one another and extend generally normal to the strip travel direction, the upper rolls are horizontally offset relative to the lower rolls whereby the strip is caused to flex upwardly and downwardly as it passes the processor rolls. This flexure forms cracks in the strip's surface scale that facilitate acid attack at the downstream pickling zone to be described in detail hereinafter.

The processor then propels the strip past an x-ray thickness gauge 51 (or similar gauge) before feeding it to a shape adjusting device where the strip is processed to remove edge wave and center buckle; to elongate the strip; to reduce its gauge; and to make it sufficiently flat, having in mind the gauge of the strip, that the brush rolls, to be described hereinafter, will uniformly contact all surfaces of the strip. While it is ideally desired that the strip be table top or absolutely flat, i.e., no meaningful deviation from a horizontal plane, it is appreciated, as a practical matter, that this is not easily attainable in an economic manner and is not necessary. However, it is necessary to achieve a sufficient degree of flatness, hereinafter referred to as substantial flatness, that uniform brushing can be successfully carried out to remove oxide scale which is not removed during chemical pickling. Light gauge strip (up to 3/16 inch (0.187")) will sufficiently deform under the pressure created when the strip is contacted by the brush rolls that a somewhat greater degree of edge wave or center buckle can be tolerated than with heavy gauge strip (3/16–3/8 inch (0.187"–0.375")). As a general rule, light gauge strip can tolerate up to 0.5" (deviation from the horizontal) of edge wave or center buckle. Heavy gauge strip, because it is less prone to resiliently deform under the pressure applied by the contacting brush rolls, can only tolerate up to 3/16–1/4 inch edge wave or center buckle. Very heavy gauge strip having a gauge greater than 0.375" up to about 0.500" can likewise be treated by the method and apparatus of the present invention provided that its yield strength is sufficiently low that the very heavy gauge strip can be recoiled on the pickle line recoiler. In order to uniformly brush strip of such very heavy gauge the tolerable edge wave or center buckle deviation from the horizontal would have to be less than 3/16–1/4 inch.

Desirably, the shape adjusting device is a two-high temper mill 52, such as the mill available commercially from the Mill Equipment Company (MECO) of Pittsburgh, Pa. These type mills are well known for secondary scalebreaking as well as for strip gauge reducing and strip elongating. Such temper mills are uniquely capable of causing about 3% strip elongation with a corresponding gauge reduction. This is very important since it has been found that elongations of about 2.5–3% tend to stretch the scale, causing it to become more brittle, with the result that it can be more easily removed than would be the case had the strip not been elongated. In addition, elongation of the strip is important for improving the mechanical properties, such as hardness, of the stainless steel strip. Two-high temper mills are particularly useful for removing edge wave by elongating the center of the strip to a greater extent than the edges. That is to say, the MECO two-high temper 52 mill is equipped with hydraulic roll bending cylinders 54 positioned generally about four feet laterally of the centerline of the mill housing 56 (FIG. 5A). A positive or convex bend or crown of up to about 0.013 inches can be induced in each of the two 38-inch work rolls 58 (FIG. 6A) by activating the roll bending cylinders 54 with up to two million pounds of hydraulic force axially applied to the ends of the work rolls. As will be appreciated by those skilled in the art, less hydraulic force applied by the roll bending cylinders 54 will result in a corresponding reduction in the crown induced in the work rolls 58. It is, however, the ability of the work rolls to be bent or crowned by cylinders 54 which affords temper mill 52 the capacity to precisely administer a desired measure of strip gauge reduction in addition to the scalebreaking, shape correction and strip elongation functions of other two-high temper mills currently used in conventional hot rolled coil processing lines.

Alternatively, the shape adjusting device may be a conventional roller leveler which comprises a series (usually 12 to 17) of very small diameter (about 50 mm to 2 inches) driven work rolls alternatingly situated above and beneath the strip and between which the strip passes. A corresponding series of back-up rolls is positioned atop each of the work rolls to prevent the work rolls from bending under the pressure of the steel strip. The strip is caused to flex upwardly and downwardly as it passes between the rolls with the result that the strip is substantially flattened. However, because the roller leveler cannot elongate the strip or reduce its gauge, it is not as effective a flattener for dealing with strip which has severe edge wave or center buckle. For the same reason, it is only slightly effective as a secondary scalebreaker.

Still another shape adjusting device is a stretcher leveler or tension leveler-type scale breaker which comprises two or more small leveler rolls preceded and followed by a pair of driven bridle rolls through which the strip passes before and after passing through the leveler rolls. Typically, the downstream bridle rolls are driven at a greater speed than the upstream bridle rolls to cause strip elongation. However, only moderate elongation can be attained with this type of shape correction device and, therefore, it also is not as effective as the two-high temper mill in flattening and scalebreaking.

Following treatment by temper mill 52, the strip thickness is then remeasured by an x-ray or similar gauge 59 after which it is engaged by a driven deflector pinch roll 60. Pinch roll 60 maintains tension in the strip upon exiting the temper mill and may be operated to selectively propel and direct the strip, as desired, to either a recoiler 62 (FIG. 6A) or further downstream toward the pickling zone of the strip treatment portion of the pickling line. Recoiler 62 is generally operated when the only processing intended for the strip is tempering. In such a case, the tempered strip is recoiled by the recoiler and transported (once coiled) from the strip treatment line by a laterally translatable exit car 64 or similar means. When a strip is to be recoiled, a belt wrapper 65 (shown in phantom) is urged against the recoiler mandrel and forms the lead end of the downwardly deflected strip about the mandrel. Once the belt wrapper detects tension in the strip, i.e., that it is being positively recoiled by the recoiler 62, the belt wrapper is retracted.

When the tempered strip is to be pickled, the strip is directed by pinch roll 60 to pass along a first delivery table 66, through a side guide 68 and then an entry crop shear 72 for squaring the entry end of the strip in preparation for pickling. Any strip scrap sheared by the crop shear 72 falls into a scrap cart 74. While still under propulsion by pinch roll 60 the strip passes a second delivery table 76 and enters a cleaning station 78, shown in FIGS. 5B and 6B. Within the cleaning station, the strip is sprayed with a mist of cleaning solution such as hot water or a caustic 10% NaOH or KOH solution which is dispensed from a plurality of spray nozzles 80 serially arranged above and below the strip in the direction of strip travel.

Upon exiting the cleaning station, the strip then passes an entry wringer roll 82 of a first pickling tank in a series of such tanks which comprise the presently preferred configuration of the pickling zone. More particularly, the pickling zone includes a plurality, desirably three, of pickling tanks of substantially similar construction and operation that are serially arranged in the direction of strip travel and which are illustrated in FIGS. 5B, 6B, 5C and 6C. The first pickling tank is identified by reference numeral 84, the second by reference numeral 86 and the third by reference numeral 88. Each tank is bounded at its entrance and exit by a wringer roll 82 to assure that the pickling liquor (described below) is substantially contained therewithin.

Figure 6B:
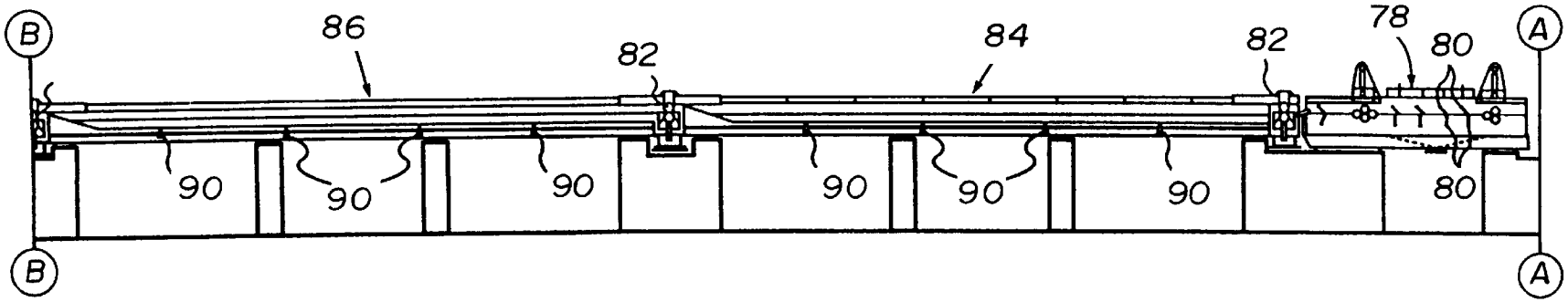
Figure 6C:
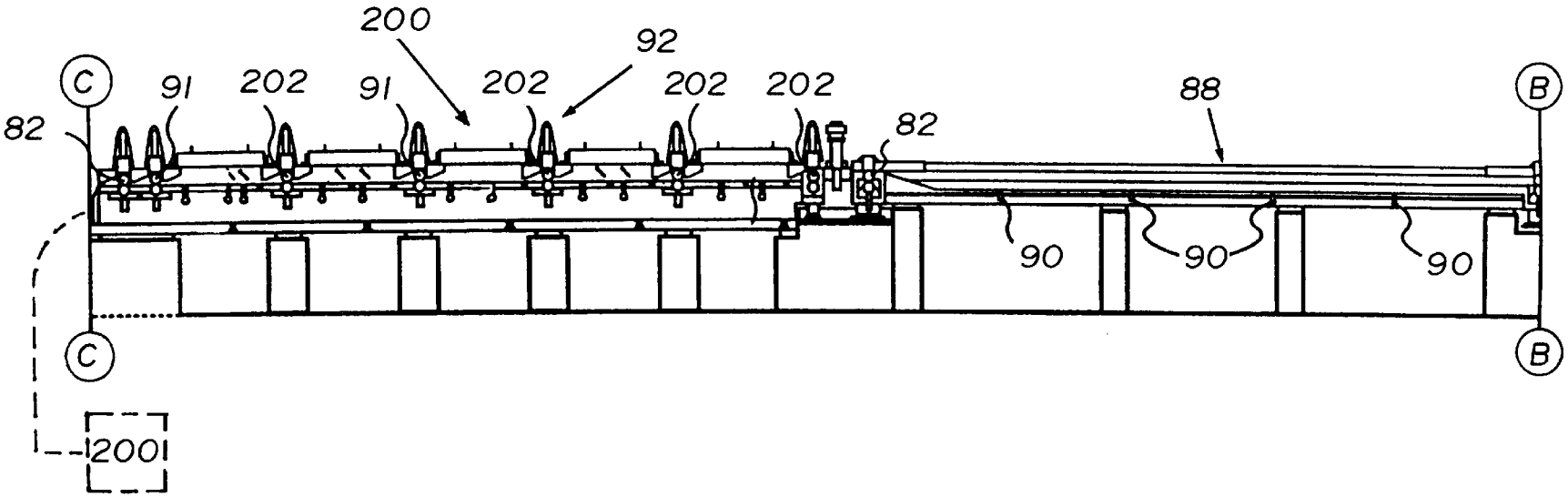

The pickle line utilizes a "turbo flow" hydrochloric acid pickling zone with an inverted laminar sparging system in each pickling tank 84, 86 and 88. In the preferred embodiment, each pickling tank is configured as a 47-foot long, shallow-bath (15 inch maximum), substantially V-shaped cross-section, granite lined tank. Hydrochloric acid is injected at about 800 gallons per minute per tank through sparging means comprising a plurality, preferably four, of substantially laminar flow producing ports 90 located in the bottom of each tank (FIGS. 6B and 6C). The sparging means direct the acid upwardly toward the bottom side of the strip in a substantially laminar flow. The flow of the acid coupled with the velocity of the moving strip cooperate to aggressively scrub the relatively thickly scaled bottom surface of the strip and rapidly dissolve scale and oxide films residing thereon. The thinner and less developed oxide films at the strip top surface, on the other hand, require less forceful acid attack and are satisfactorily removed at essentially the same rate as the bottom surface scale via the usual turbulence created by a strip travelling through a pickling bath.

It is well known that the rate of pickling increases in direct proportion to the concentration of the pickling acid and that the influence of temperature is even more pronounced. It is important that the acid concentrations and tank temperatures be selected to accomplish the desired descaling within a commercially reasonable period of time while, at the same time, appreciating that increased acid concentrations significantly increase material costs. Higher temperatures increase pickling rate but also cause the acid to fume and to be discharged up the exhaust stack, thereby wasting expensive materials and significantly increasing material costs. Fundamentally, pickling is a time-temperature-concentration-additive dependent phenomena, the parameters of which are basically dictated by economics. For this reason, tank temperatures are preferably maintained within the following temperature ranges: first pickling tank 84°–190° to 195°; second pickling tank 86°–185° to 190°; third pickling tank 88°–about 185°. Likewise, it is desirable to maintain the acid concentration in each of the tanks in the following ranges: first pickling tank 84–13% to 17%, preferably 15%, by volume HCl; second pickling tank 86–8% to 12%, preferably 10%, by volume HCl; third pickling tank 88–6% to 10%, preferably 8%, by volume HCl.

Unlike carbon steel pickling, which utilizes inhibitors in the pickling bath to reduce localized attack on the base metal after local descaling is completed, in accordance with the present invention, descaling of stainless steels, such as AISI Series 400 stainless steels, is accomplished without inhibitors. This is because in the descaling of stainless steels it is not necessary to retard the pickling rate since chemical descaling with dilute acids seldom, if ever, exposes the base metal. Rather, instead of producing a clean, shiny surface, as is desired, dilute acid pickling of stainless steels, particularly high chromium content stainless steels, typically leaves a brownish colored chromium oxide coating which the hydrochloric acid is unable to remove, thus necessitating the vigorous post-pickling brushing of the strip surfaces in brushing station 200 which forms a part of the present invention and is discussed more fully hereinafter. Indeed, rather than utilizing an acid inhibitor, it is frequently desirable to add an acid accelerator to the pickling bath in order to make the hydrochloric acid attack the oxide film more aggressively. It has been found that the addition of an acid accelerator in amounts from about 0.2% to about 0.25%, preferably about 0.22%, by volume based upon the volume of acid, has the effect of increasing the pickling rate up to about 12.5%. For this purpose, an acid accelerator such as Sunspeed PA7, commercially available from the Harry Miller Company of Philadelphia, Pa., has been found to be suitable.

Iron oxides can thus be removed at cost effective line speeds (i.e., up to about 250 ft./min.) from both the bottom and the top surfaces of hot-rolled stainless steel strips traditionally possessing difficult steel chemistries with respect to oxide formation and retention. Even annealed stainless steels, wherein the annealing causes the oxide scale to have a finer structure and a greater thickness, can be satisfactorily pickled, at least in terms of their iron oxide scale, at cost effective line speeds, albeit the line speeds are somewhat slower than for unannealed stainless steel strips having similar chemistry and processing histories. In addition, the V-shaped cross-section of the pickle tanks in combination with the shallow bath depth assures vigorous recirculation and, therefore, optimum chemical utilization of the acid solution per unit volume thereof. Furthermore, the substantial reduction in both length and volume of the pickling tank from heretofore used traditional tanks produces tangible reductions in materials and energy consumption in relation to conventional pickling zones. Following pickling, the strip enters a rinsing station 92 (FIGS. 5C and 6C) comprising a flash pickle section and several stages of water dispensing nozzles which direct counter current sprays or streams of rinse water at the strip.

Figure 5B:
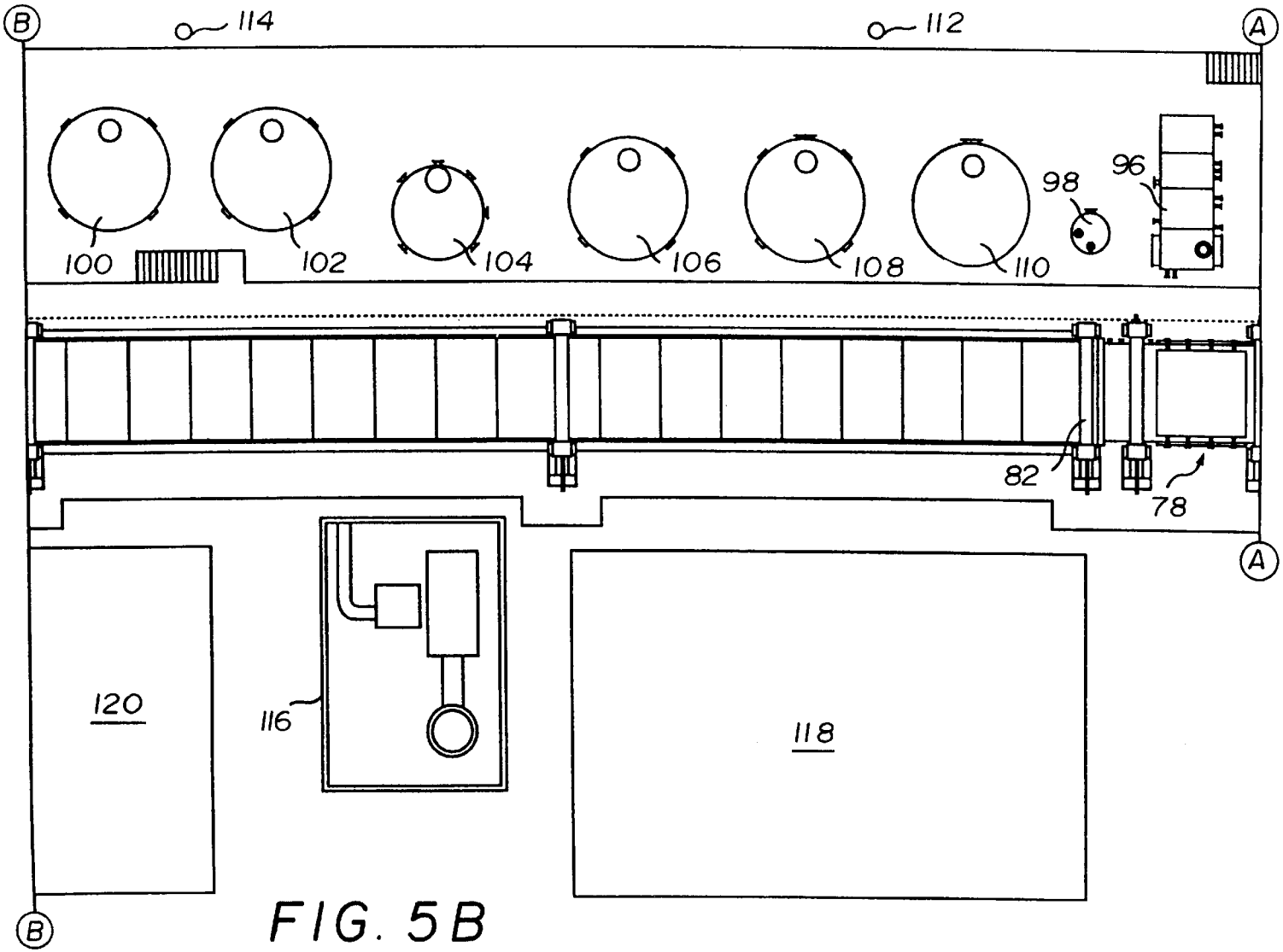
Figure 5C:
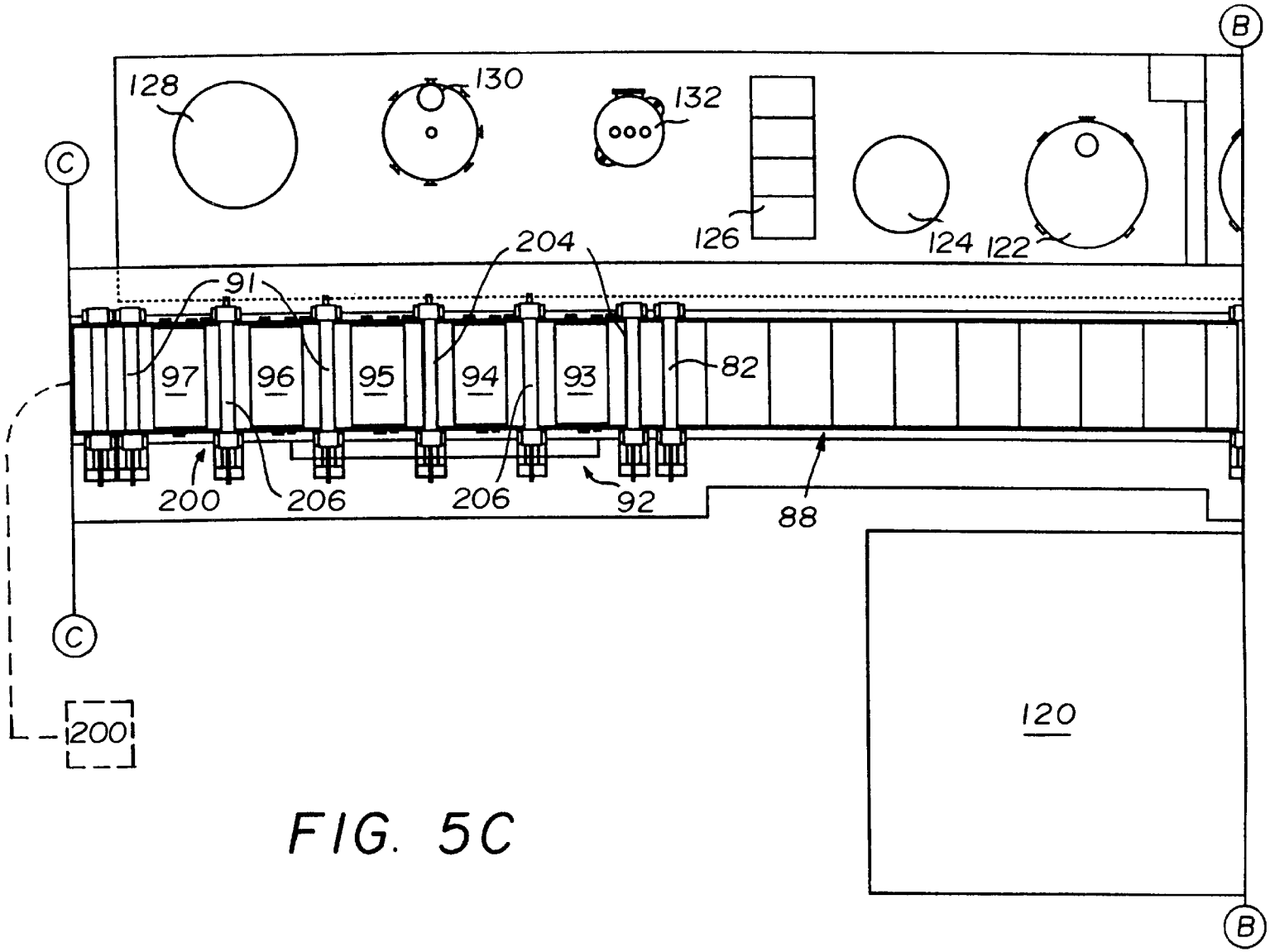

With further reference to FIGS. 5B and 5C, it will be seen that the strip treatment portion 46 includes various storage tanks for the cleaning solution, acid solution, spent pickling liquor, rinsing water and other materials that are required at various stages of the strip treatment process. For example, FIG. 5B illustrates a cleaning solution recirculation tank 96 and clean rinse tank 98 employed in the strip cleaning process occurring at the cleaning station 78. Likewise, FIG. 5B also depicts first and second fresh acid storage tanks 100 and 102, first and second acid recirculation tanks 104 and 106, and first and second spent pickling liquor tanks 108 and 110. A spent acid discharge station is identified by reference numeral 112 and an acid fill station by reference numeral 114. A fume emission control station is identified by numeral 116, a motor control room by numeral 118 and a boiler room by numeral 120. Also included, but not illustrated, are numerous operator stations including both manual and automated controls for such parameters as steel quality monitoring, acid bath acid and reaction product concentration monitoring and temperature control.

FIG. 5C illustrates the third acid recirculation tank 122. A buffer tank 124 and neutralizing tank 126 store suitable materials for controlling the pH of the waste water solution used in the rinsing station 92. A caustic material storage tank 128 is also shown, as are a water collection tank 130 and condensate tank 132 for use in operation of the rinsing station 92. For clarity of illustration, the necessary pumps conduits and related equipment for delivering water, acid, cleaning solution and other materials to and from the various stations in the strip treatment portion 46 of the steel strip pickling line are not illustrated as such equipment will be readily understood by the ordinarily skilled artisan and is not central to the present invention. Additionally, it will be appreciated that the dimensions, number and configurations of the pickling tanks in the pickling zone, as well as their operational characteristics, may be somewhat varied within the scope of the invention, as conditions dictate, to effect satisfactory pickling of steel.

Rinsing station 92 comprises a plurality of rinse tanks 93, 94, 95, 96, 97, desirably five, serially arranged in the direction of strip travel and which are illustrated in FIG. 5C (alternatively a single rinse tank having a plurality of spaced partitions which effectively separate the single tank into a plurality of rinse cells can be used). Upon passing through the exit wringer roll 82 of the third pickling tank 88, the strip passes through rinsing sprays in each rinse tank which wash any residual acid from the strip. In order to avoid acid carryover it is desirable to confine and retain the rinse liquid within each rinse tank. This has the desirable effect of reducing the acid concentration in the drain liquid in each succeeding rinse tank along the direction of strip travel. In a typical pickling line, this is accomplished by positioning wringer rolls at the entrance and exit of each rinse tank in order to retain within each tank the acid washed off by the rinse liquid in that tank.

Figure 8:
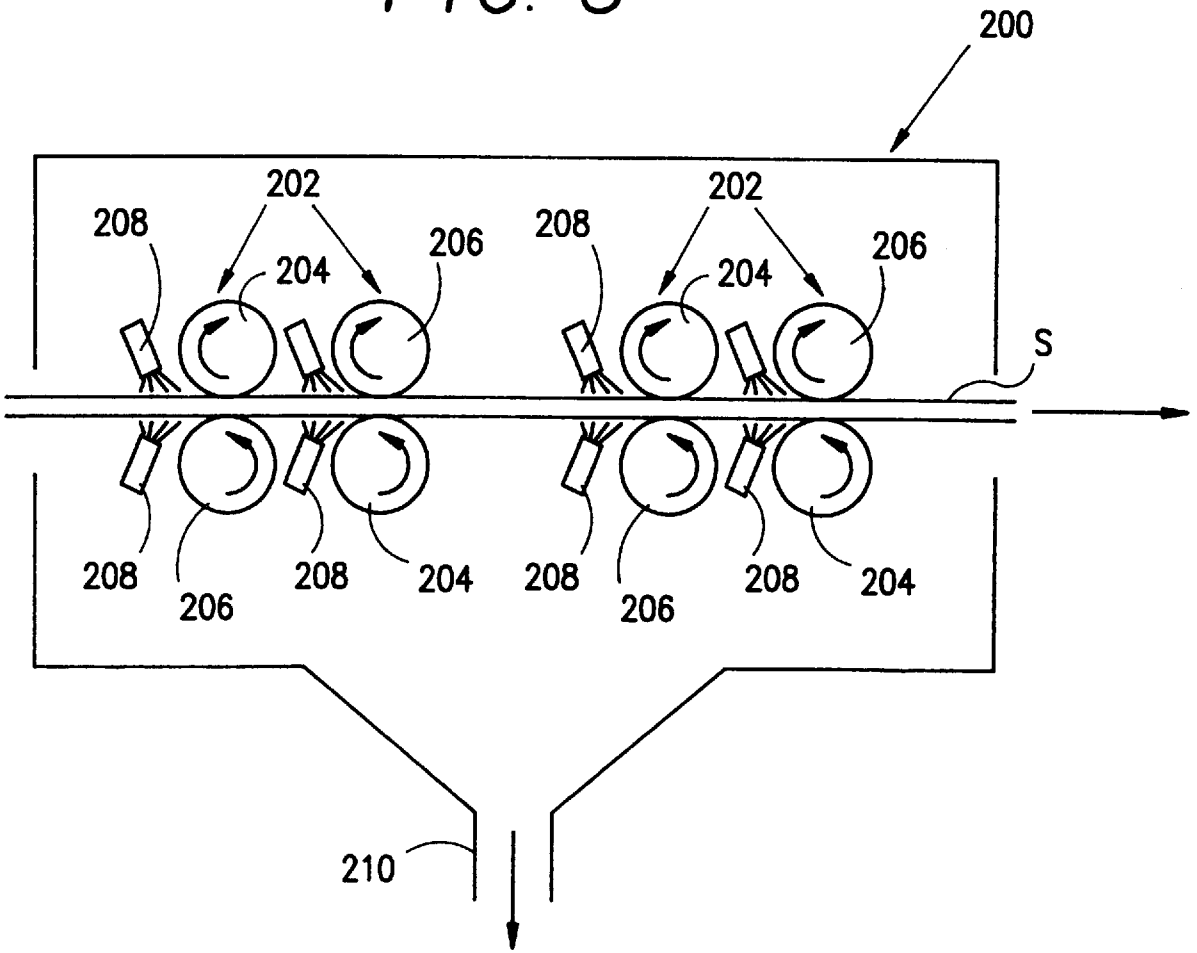
FIG. 8 is a schematic view of a brushing station of a pickle line in accordance with the present invention.

In accordance with the present invention, a strip brushing station 200 (FIG. 8) is positioned downstream of the pickling tanks and, desirably, downstream of at least an initial acid rinse cell, to remove by vigorous brushing the oxide scale, typically chromium oxides for high chromium content stainless steels such as AISI 409 stainless steel, which remains on the strip following chemical pickling in dilute acid, such as hydrochloric acid. In order to remove the oxide scale which remains on the surface of the stainless steel strip following chemical pickling, the brushing station includes a plurality of grinding brush roll assemblies 202 arranged in series along the direction of strip travel. As can be seen in FIG. 8, each grinding brush roll assembly 202 includes a grinding brush roll 204 and a backing roll 206 generally opposing each other on opposite sides of the strip S. In adjacent grinding brush roll assemblies 202 the grinding brush roll is alternately above and below the strip in order to provide a vigorous brushing action for removing the oxide scale from both the upper and lower surfaces of the strip. Both grinding brush rolls 204 and backing rolls 206 are driven to rotate in the direction counter to the direction of travel of the stainless steel strip in order to produce the desired vigorous grinding action which removes the oxide scale. The scale which is abraded from the strip surface by the grinding brush rolls 204 is desirably washed away from the strip by a spray 208 of water directed at least at the grinding brush rolls and is discharged via a discharge conduit 210 from the brushing station 200. It is important that the spray 208 is directed at the grinding brush rolls for cooling the brushes and removing the abraded scale in order that it doesn't clog the voids of the brush and render the brush ineffective for its intended purpose.

Figure 9:
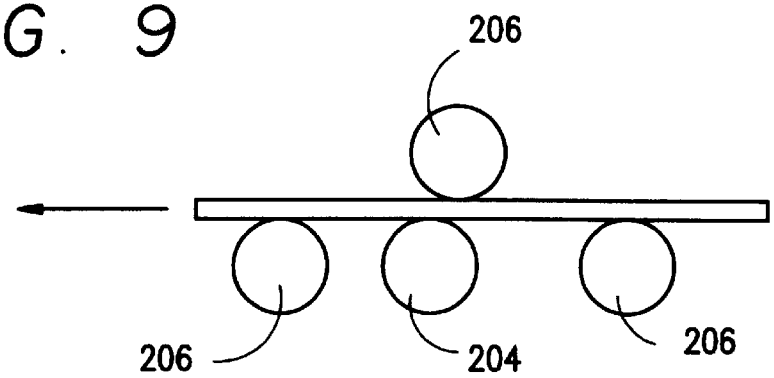
FIG. 9 is a schematic view of a preferred grinding brush roll/back-up rolls configuration when the brush roll is located below the strip.
Figure 10:
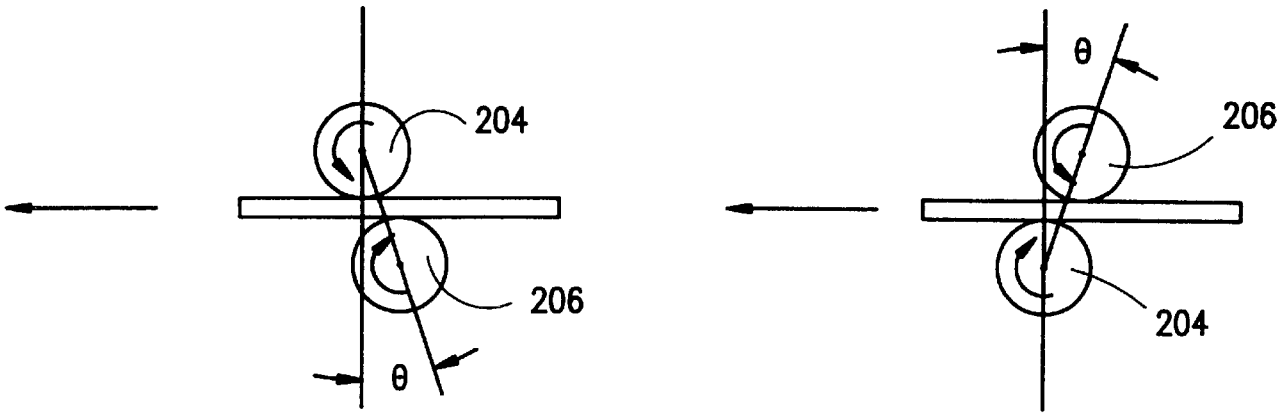
FIG. 10 is a schematic view of the preferred grinding brush roll-back up roll center-to-center axis offset configurations when the brush roll is located above and when the brush roll is located below the strip.

In practice, the grinding brush roll 204 operates on one side of the strip while the backup roll 206 operates on the other side of the strip. When the grinding brush roll 204 is on the top of the strip and the backing roll 206 is beneath the strip, the backing roll 206 provides good support for the brush roll and the strip, allowing infinite positioning and loading of the grinding brush relative to the strip, and contributing to long brush life. However, when the grinding brush roll 204 is beneath the strip and the backing roll 206 is on top of the strip, although oxide scale grinding is effective, a diminished grinding brush life is experienced because the grinding brush roll 204 is performing a support, as well as a brushing, function. In order to provide better grinding brush roll life when the grinding brush roll is located below the strip, it has been found to be advantageous to provide additional backing rolls 206 positioned upstream and downstream, relative to the direction of strip travel, of the grinding brush roll, as is shown in FIG. 9. In addition, it has been found that if the grinding brush roll-backing roll center-to-center axis is offset from the vertical by a very small acute angle $\theta$, preferably in the range 3° to 6°, desirably about 4°, with the grinding brush roll 204 downstream of the backing roll 206, as is shown in FIG. 10, brush life is noticeably enhanced.

The preferred grinding brush rolls for use in accordance with the present invention are formed of non-woven synthetic fibers onto which abrasive particles have been bonded with a resin adhesive. Suitable abrasives include, without limitation, SiC and $Al_2O_3$. Suitable brushes are commercially available from 3M Abrasive Systems Division of St. Paul, Minn. under the trade designation XDR5A Medium Finishing and Cleaning Brush. The preferred backing rolls for use in accordance with the present invention are very hard rubber covered rolls, such as 80–100 durometer neoprene coated rolls. Alternatively, any very hard backing roll, such as stainless steel rolls or hardened carbon steel rolls, can be employed.

In a preferred embodiment of the present invention the brushing station 200 is combined with rinsing station 92. This permits use of existing carbon steel pickling plants for the processing of stainless steel strip. With reference to FIGS. 5C and 6C this can be readily accomplished by substituting a grinding brush assembly 202 for two or more of the wringer rolls which are located at the entrance and/or exits of the rinse tanks. In a particularly desirable arrangement, wringer rolls at the entrance to first rinse tank 93 and the exit of second rinse tank 94 are each replaced with a grinding brush assembly 202 in which the grinding brush roll 204 is positioned above the strip. At the same time, the wringer rolls at the exits of the first and fourth rinse tanks 93, 96 are each replaced with a grinding brush assembly 202 in which the grinding brush roll 204 is positioned below the strip. Wringer rolls 91 remain in place at the exits of the third and fifth rinse tanks 95, 97. In this way, the grinding brush assemblies 202 function both as grinding brushes to vigorously scrub the oxide film from both surfaces of the strip and as wringer rolls for essentially isolating each of the rinse tanks to prevent carryover. At the same time the rinse header in rinsing station 92 is modified or replaced to assure that rinse spray 208 is directed at least at the brush rolls in order that the spray may serve both to wash carryover pickling acid from the strip surfaces and to wash away scale which has been abraded from the strip surfaces. In another embodiment of the invention, a brushing station 200, such as is illustrated schematically in FIG. 8, is positioned downstream of rinsing station 92, as is shown in phantom in FIGS. 5C and 6C.

Figure 11:
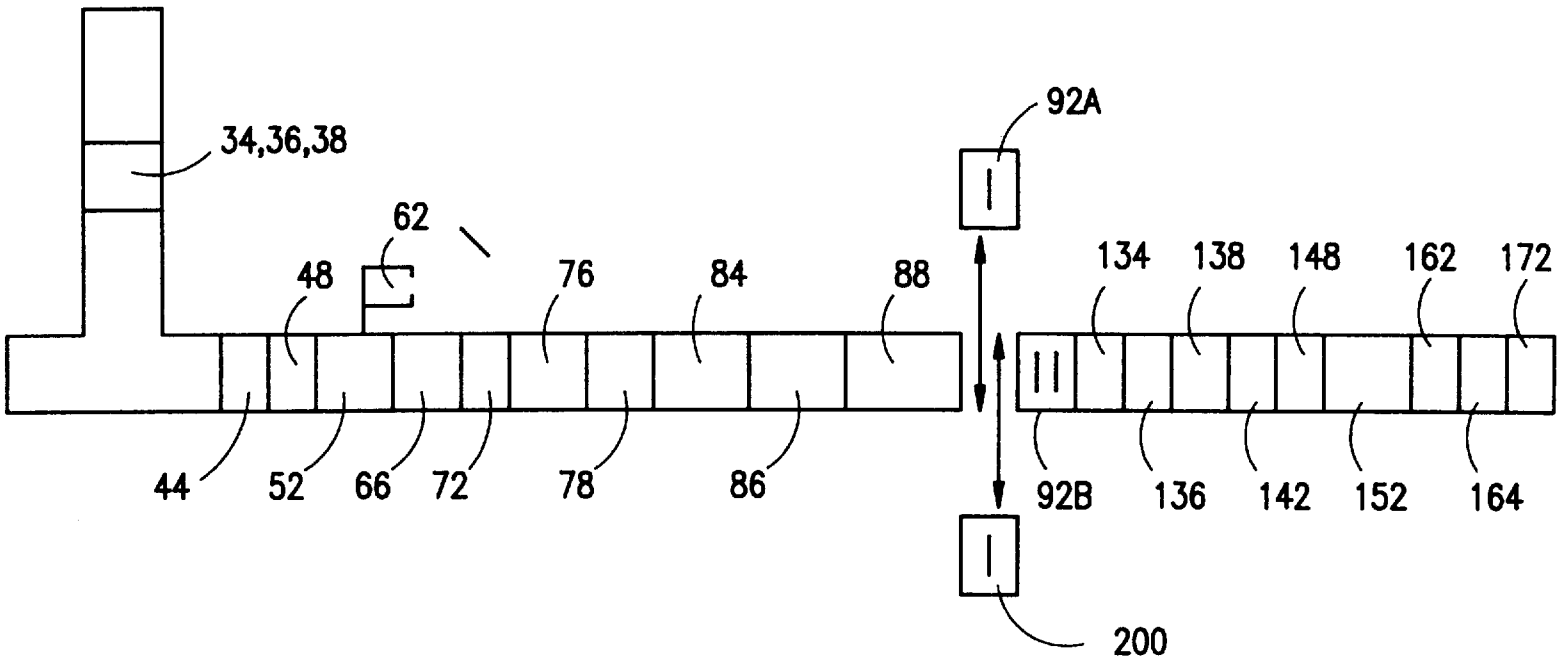
FIG. 11 is a block diagram of a pickle line in accordance with the present invention which includes interchangeable modular rinsing and brushing stations.

As a practical matter, removing wringer rolls from the rinsing station and replacing them with grinding brush assemblies each time that it is desired to process stainless steel strip, although functional and effective, is uneconomically time consuming. Therefore, in another embodiment of the present invention, a portion of the rinsing station is constructed as a modular unit and is mounted in the pickling line for insertion therein and removal therefrom, for example by sliding on rails or by lifting and emplacing via a crane. At the same time a modular brushing station is likewise mounted for insertion into and removal from the pickling line, for example on rails or via crane as with the modular rinsing station. In this manner a pickling line, as described herein, could be effectively used for pickling carbon steel and other conventional non-stainless strip with the modular rinsing station inserted into the pickling line downstream of the pickling tanks. However, when the pickling line is to be used for a difficult to chemically pickle strip, such as AISI Series 400 stainless steel, which typically contains about 12–18% chromium, the modular rinsing station may be removed from the pickling line and the modular brushing station inserted into the pickling line. A pickling line containing a permanently installed rinsing station 92B, a modular rinsing station 92A for insertion into and removal from the pickling line downstream of pickling tanks 84, 86, 88 and upstream of permanently installed rinsing station 92B and a modular brushing station 200 for insertion into and removal from the pickling line in place of modular rinsing station 92A is illustrated in a block diagram in FIG. 11. When a conventional carbon steel or equivalent non-stainless steel strip is to be pickled, modular brushing station 200 is removed from the pickling line and modular rinsing station 92A is inserted immediately upstream of permanently installed rinsing station 92B. Together, modular rinsing station 92A (equivalent to rinse tanks 93 and 94 and associated wringer rolls) and permanent rinsing station 92B (equivalent to rinse tanks 95, 96 and 97 and associated wringer rolls) provide a multi-tank rinsing station equivalent to rinsing station 92 described hereinbefore in connection with FIGS. 5C and 6C. When a stainless steel strip is to be pickled, modular rinsing station 92A is removed and modular brushing station 200, an embodiment of which is shown in FIG. 8, is inserted into the pickling line in its place.

Figure 5D:
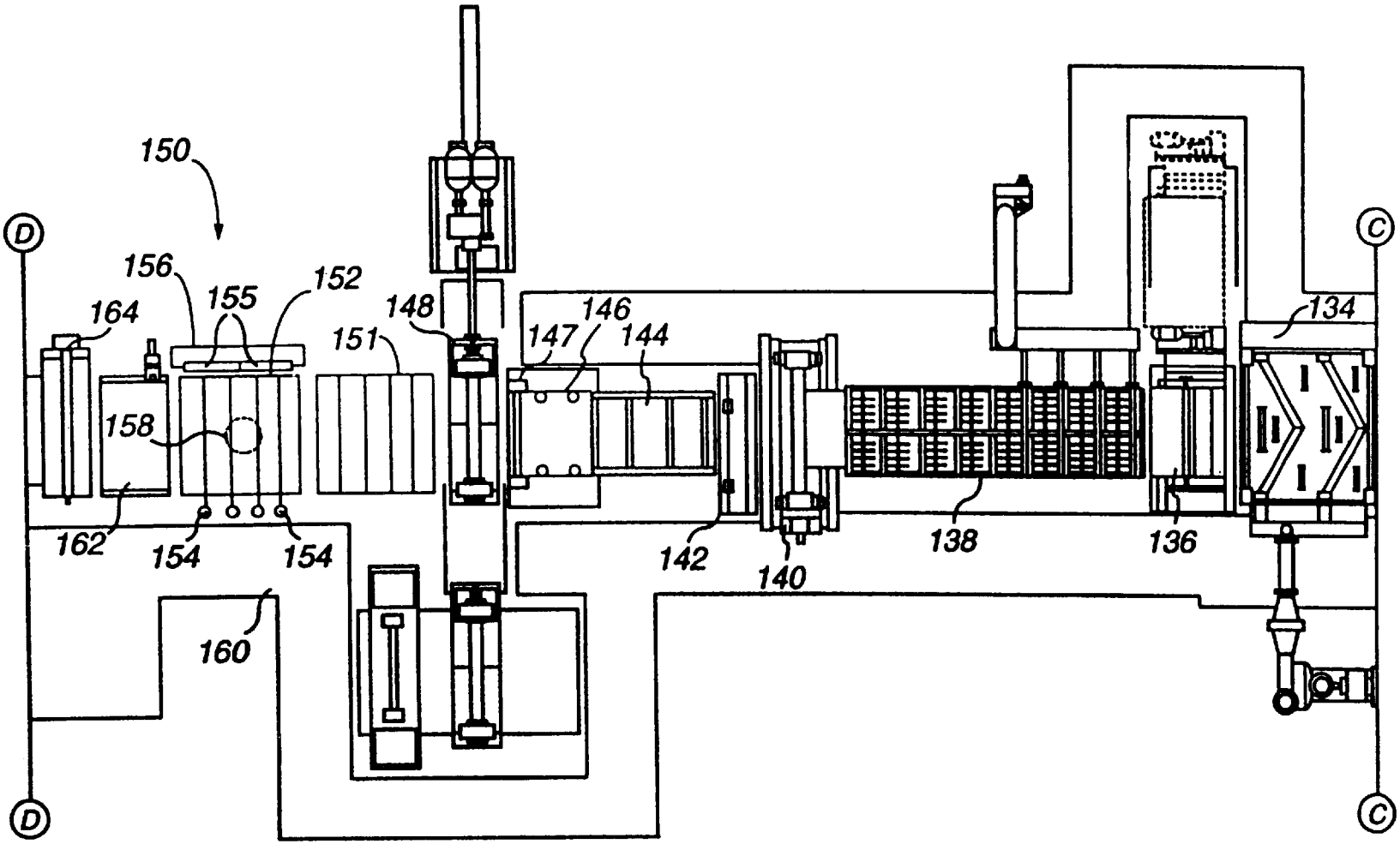
Figure 6D:
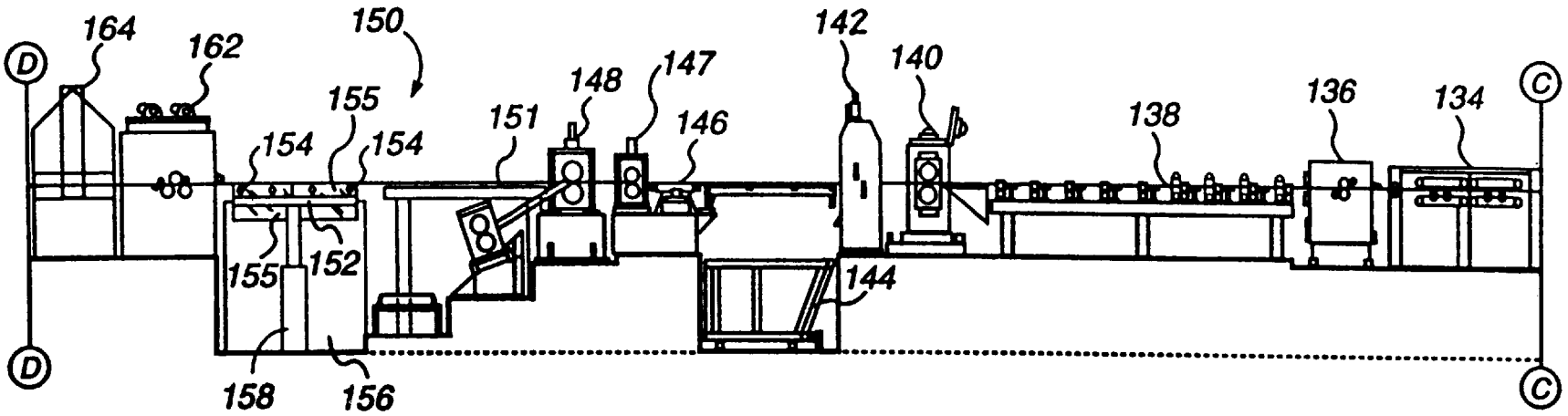

After the strip has been rinsed and vigorously brushed to remove oxide scale in combined rinsing/brushing stations 92, 200 it enters a strip dryer 134 shown in FIGS. 5D and 6D, which dryer may be of the hot air or equivalent type. The strip may then optionally be coated at a coating station 136, preferably with a dry lubricant such as GilCote® manufactured by Mangil Corp. of Cleveland, Ohio. Following coating at station 136 the strip passes over a dryer and carryover table 138 before entering a pinch roll 140 and exit resquare shear 142. Shear 142 is operable to square the trailing end of the pickled strip prior to recoiling. Scrap strip sheared by shear 142 falls into a scrap cart 144. Subsequent to passing shear 142 the strip enters side guides 146, preferably of the roller type, and, thereafter, a slitter pinch roll 147 and then an adjustable slitter/side trimmer 148. The slitter/side trimmer cuts the strip into accurate and uniform width while also enabling the strip, if desired or necessary, to be cut into two or more narrower strips suitable for coiling.

A run out table 150 follows the trimmer/slitter 148. The run out table includes an inspection table 152 carrying a battery of lights 154. Lights 154 preferably assume the form of high-intensity mercury arc spotlights, although illumination meanmirrors 155 abrightness would be acceptable. One or more mirrors 155 are pivotally supported on a stationary platform 156 situated generally opposite lights 154. Normally, the mirror(s) 155 are oriented at about 60° to the horizontal but may be adjusted according to the inspector's preference. The inspection table further comprises means 158 for adjusting the elevation of the table whereby the table may be sufficiently lowered as the strip passes thereover to expose the bottom surface of the strip to illumination by lights 154 and permit reflection of the bottom surface by mirrors 156. Adjusting means 158 may be extensible and retractable means such as, for example, motor driven scissor jacks, screw jacks, hydraulic or pneumatic cylinders or similar apparatus known in the art. So constructed, the run out table permits both strip surfaces to be simultaneously observed and inspected by the line operator/inspector as the strip passes an operating platform 160 (FIG. 5D). Under normal operation, the inspector activates the adjusting means 158 causing the inspection table 152 and lights 154 supported thereby to lower. The lowered inspection table then trips an unillustrated limit switch to turn on the lights. When inspection is completed, the table 152 may then be raised and the lights 154 turned off by the inspector utilizing suitable controls or, alternatively, by a sensor which detects the trailing end of the strip and transmits a signal to cause the adjusting means to raise the table and turn off the lights.

Subsequent to the run out table, the strip is engaged by rubber coated brake rolls 162 which lead the strip through an oiler station 164 preferably comprising an electrostatic oiler or other suitable oil applicator. The oiler station operates to coat both surfaces of the pickled strip with oil for lubrication and protection during storage and handling. Moreover, the oil composition is preferably selected to be one which is compatible with the lubrication system of the cold-mill reduction unit (not illustrated) within which the steel strip may be later processed.

The strip then progresses to a deflector pinch roll mechanism 165 that desirably includes an edge guide 166 and reel chute 168. The deflector pinch roll mechanism deflects the strip onto one of two mandrels 170 or 178 of an exit recoiler 172. The exit recoiler serves as the final component of the strip treatment portion 46 as well as the initial component of a coil delivery portion 174 of the pickle line of the present invention.

Figure 5E:
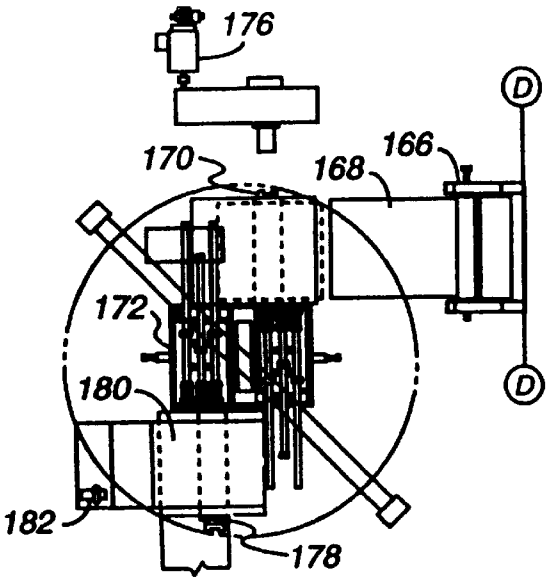
Figure 7:
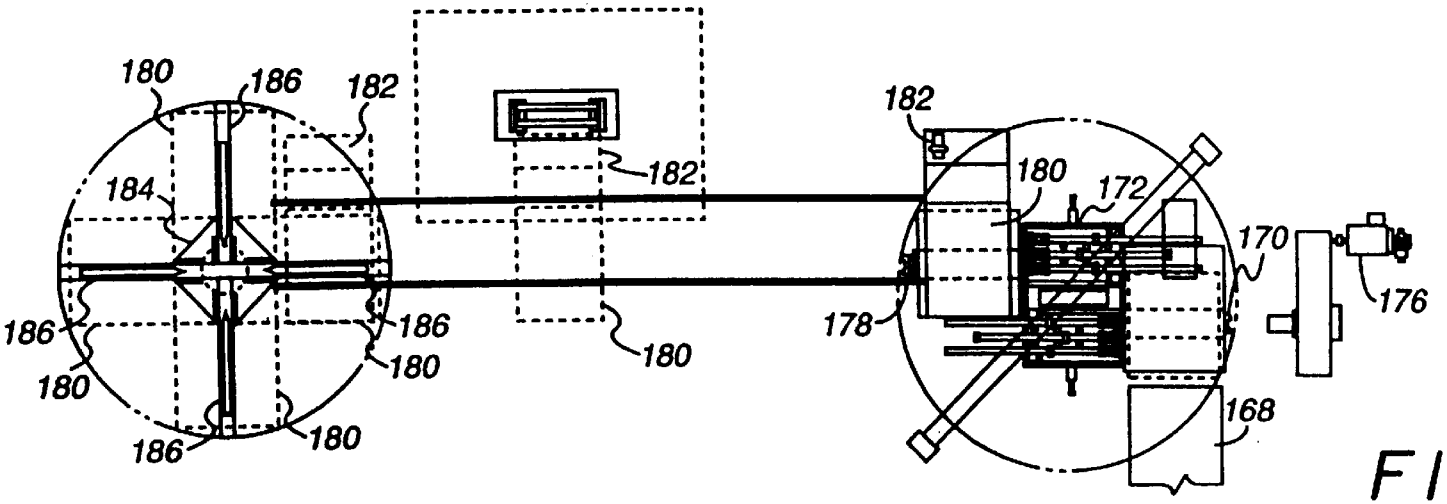
FIG. 7 is a plan view of the coil delivery portion of a pickle line constructed in accordance with the present invention.

The exit recoiler is driven by a motor 176. Preferably, the exit recoiler is configured as a dual mandrel turret recoiler, the second mandrel thereof being identified, as noted hereinabove, by reference numeral 178. The recoiler 172 is thus capable of recoiling a first pickled strip about one mandrel thereof, e.g., first mandrel 170, then rotating 180° under propulsion of suitable unillustrated drive means to situate the strip coil into a discharge position while presenting the other mandrel, e.g., second mandrel 178, into position for recoiling a second length of pickled strip. The aforesaid discharge position is that of the second mandrel 178 in FIG. 5E. From the discharge position, the coiled strip 180 is delivered by a second motorized, reciprocable coil car 182 (shown in various locations in its course of travel in FIGS. 5E, 6E, and 7) to a multiple arm turnstile 184, the final component of the coil delivery portion 174. The turnstile according to the presently preferred embodiment possesses four radially directed coil support arms 186 each of which may receive a coil 180 from coil car 182. Once the coil is appropriately engaged by an arm 186, the turnstile may be turned to orient the coil such that it can be removed by a grapple or hook of a suitable coil lifting device (not shown) which may place the coil at a selected site. The operations of the exit recoiler 172, the second conveyor 182 and turnstile 184 are coordinated with one another, as well as with the coil entry and treatment portions of the pickle line, such that delivery efficiency of pickled coils may be optimized.

Although the invention has been described in detail for the purpose of illustration, it is to be understood that such detail is solely for that purpose and that variations can be made therein by those skilled in the art without departing from the spirit and scope of the invention except as it may be limited by the claims.

We claim:

1. A method of removing oxide scale from the surface of hot-rolled stainless steel strip, said oxide scale including oxides of iron and stainless steel alloying elements, comprising the steps of:

(a) uncoiling said stain(b)s steel strip from a coil of said strip;

(b) flattening said strip sufficiently, depending upon the gauge of said strip, to permit mechanical descaling means to uniformly contact the surfaces of said strip;

(c) pickling said flattened strip in a hydrochloric acid solution to remove a portion of the stainless steel oxide scale from the surface thereof;

(d) mechanically abrading the stainless steel oxide scale remaining on the strip surfaces following hydrochloric acid pickling to remove said scale; and (e) recoiling said strip.

2. A method of removing oxide scale from the surface of hot-rolled stainless steel strip, as claimed in claim 1, wherein said flattening step includes controllably elongating the strip and breaking the oxide scale on the surface of the strip.

3. A method of removing oxide scale from the surface of hot-rolled stainless steel strip, as claimed in claim 2, wherein said strip is caused to elongate by rolling in a temper mill.

4. A method of removing oxide scale from the surface of hot-rolled stainless steel strip, as claimed in claim 1, wherein said strip is flattened, reduced in gauge and shape corrected to substantially remove edge wave and center buckle by rolling in a temper mill, whereby the oxide scale on the surface of the hot-rolled strip is broken to increase the surface area thereof available for acid pickling attack.

5. A method of removing oxide scale from the surface of hot-rolled stainless steel strip, as claimed in claim 1, wherein said strip is controllably flattened to achieve substantial strip flatness, the tolerable deviation from absolute strip flatness depending upon the gauge of the strip.

6. A method of removing oxide scale from the surface of hot-rolled stainless steel strip, as claimed in claim 5, wherein the tolerable deviation from absolute strip flatness decreases with increasing strip gauge.

7. A method of removing oxide scale from the surface of hot-rolled stainless steel strip, as claimed in claim 1, wherein the oxide scale is mechanically abraded by contacting an oxide scale-containing strip surface with at least one grinding brush roll.

8. A method of removing oxide scale from the surface of hot-rolled stainless steel strip, as claimed in claim 7, wherein the oxide scale is mechanically abraded by contacting each of the oxide scale-containing surfaces of the strip with at least one grinding brush roll.

9. A method of removing oxide scale from the surface of hot-rolled stainless steel strip, as claimed in claim 8, including the step of rinsing the abraded oxide scale from the brush rolls and the strip surfaces.

10. A method of removing oxide scale from the surface of hot-rolled stainless steel strip, as claimed in claim 9, wherein said flattening step includes controllably elongating the strip and breaking the oxide scale on the surface of the strip.

11. A method of removing oxide scale from the surface of hot-rolled stainless steel strip, as claimed in claim 10, wherein said strip is caused to elongate by rolling in a temper mill.

12. A method of removing oxide scale from the surface of hot-rolled stainless steel strip, as claimed in claim 9, wherein said strip is flattened, reduced in gauge and shape corrected to substantially remove edge wave and center buckle by rolling in a temper mill, whereby the oxide scale on the surface of the hot-rolled strip is broken to increase the surface area thereof available for acid pickling attack.

13. A method of removing oxide scale from the surface of hot-rolled stainless steel strip, as claimed in claim 9, wherein said strip is controllably flattened to achieve substantial strip flatness, the tolerable deviation from absolute strip flatness depending upon the gauge of the strip.

14. A method of removing oxide scale from the surface of hot-rolled stainless steel strip, as claimed in claim 13, wherein the tolerable deviation from absolute strip flatness decreases with increasing strip gauge.

15. A method of removing oxide scale from the surface of hot-rolled stainless steel strip, as claimed in claim 11, wherein said strip is pickled in an uninhibited hydrochloric acid solution containing an acid accelerator.

16. A method of removing oxide scale from the surface of hot-rolled stainless steel strip, as claimed in claim 12, wherein said strip is pickled in an uninhibited hydrochloric acid solution containing an acid accelerator.

17. A method of removing oxide scale from the surface of hot-rolled stainless steel strip, as claimed in claim 14, wherein said strip is pickled in an uninhibited hydrochloric acid solution containing an acid accelerator.

18. A pickle line operable to remove oxide scale from the surface of hot-rolled stainless steel strip, said oxide scale including oxides of iron and stainless steel alloying elements, comprising:

(a) means for uncoiling stainless steel strip from a coil of said strip;

(b) means for controllably flattening said strip sufficiently, depending upon the gauge of said strip, to permit mechanical descaling means to uniformly contact the surfaces of said strip;

(c) means for pickling said flattened strip in a hydrochloric acid solution to remove a portion of the stainless steel oxide scale from the surface thereof;

(d) mechanical descaling means for removing the stainless steel oxide scale remaining on the strip surfaces following hydrochloric acid pickling; and (e) means for recoiling said strip.

19. A pickle line, as claimed in claim 18, wherein said means for controllably flattening said strip comprises means for controllably elongating said strip and for breaking the oxide scale on the surface of the strip.

20. A pickle line, as claimed in claim 19, wherein said means for controllably flattening said strip flattens said strip to achieve substantial strip flatness, the tolerable deviation from absolute strip flatness depending upon the gauge of the strip.

21. A pickle line, as claimed in claim 20, wherein the tolerable deviation from absolute strip flatness decreases with increasing strip gauge.

22. A pickle line, as claimed in claim 19, wherein said means for controllably flattening said strip comprises temper mill means positioned between said uncoiling means and said pickling means for controllably flattening said strip by substantially removing edge wave and center buckle, controllably reducing strip gauge and breaking the oxide scale on the strip surface.

23. A pickle line, as claimed in claim 22, wherein said temper mill comprises a two-high temper mill including a pair of work rolls between which said strip passes and means for applying axial force to said work rolls to induce bending therein.

24. A pickle line, as claimed in claim 18, wherein said mechanical descaling means comprises brushing means for abrading the oxide scale from the strip surface.

25. A pickle line, as claimed in claim 24, wherein said brushing means comprises at least one grinding brush roll in contact with each of the scale-containing strip surfaces.

26. A pickle line, as claimed in claim 25, wherein said brushing means comprises at least two grinding brush roll assemblies arranged in series along the direction of strip travel, each assembly including a grinding brush roll and at least one backing roll opposing each other on opposite surfaces of the strip, the grinding brush roll being positioned alternately above and below the strip in adjacent assemblies and adapted to rotate in the direction counter to the direction of travel of the strip.

27. A pickle line, as claimed in claim 26, further including two additional backing rolls positioned upstream and downstream, relative to the direction of strip travel, of and on the same surface as the grinding brush roll when the grinding brush roll is positioned below the strip.

28. A pickle line, as claimed in claim 26, wherein the grinding brush roll-backing roll center-to-center axis is offset from the vertical by an angle in the range 3° to 6° with the grinding brush roll positioned downstream of the backing roll.

29. A pickle line, as claimed in claim 28, wherein the grinding brush roll-backing roll center-to-center axis is offset from the vertical by an angle of about 4°.

30. A pickle line, as claimed in claim 26, wherein said grinding brush roll comprises synthetic fibers onto which abrasive particles are bonded using a resin adhesive.

31. A pickle line, as claimed in claim 26 including means for rinsing the abraded scale from the grinding brush rolls and the strip.

32. A pickle line, as claimed in claim 26, wherein said means for controllably flattening said strip comprises means for controllably elongating said strip and for breaking the oxide scale on the surface of the strip.

33. A pickle line, as claimed in claim 32, wherein said means for controllably flattening said strip flattens said strip to achieve substantial strip flatness, the tolerable deviation from absolute strip flatness depending upon the gauge of the strip.

34. A pickle line, as claimed in claim 33, wherein the tolerable deviation from absolute strip flatness decreases with increasing strip gauge.

35. A pickle line, as claimed in claim 32, wherein said means for controllably flattening said strip comprises temper mill means positioned between said uncoiling means and said pickling means for controllably flattening said strip by substantially removing edge wave and center buckle, controllably reducing strip gauge and breaking the oxide scale on the strip surface.

36. A pickle line, as claimed in claim 35, wherein said temper mill comprises a two-high temper mill including a pair of work rolls between which said strip passes and means for applying axial force to said work rolls to induce bending therein.

37. A pickle line operable to remove oxide scale from the surface of hot-rolled steel strip comprising:

(a) means for uncoiling steel strip from a coil of said strip;

(b) means for controllably flattening said strip by substantially removing edge wave and center buckle, controllably reducing strip gauge and breaking the oxide scale on the strip surface;

(c) means for pickling said flattened strip in a hydrochloric acid solution to remove at least a portion of the oxide scale from the surface thereof;

(d) modular mechanical descaling means for removing the oxide scale remaining on the strip surfaces following hydrochloric acid pickling, said modular descaling means including means for rinsing the scale from the descaling means and the strip and being movable between a first position immediately downstream of the pickling means and upstream of the recoiling means when said hot-rolled strip is a stainless steel strip and a second position removed from the pickle line when said hot-rolled strip is not a stainless steel strip;

(e) modular rinsing means for applying a water spray to the strip to wash residual pickling acid from the strip, said modular rinsing means being movable between a first position immediately downstream of the pickling means and upstream of the recoiling means when said hot-rolled strip is not a stainless steel strip and a second position removed from the pickle line when said hot-rolled strip is a stainless steel strip, said modular descaling means being in its first position when the modular rinsing means is in its second position and vice versa; and (f) means for recoiling said strip.

38. A pickle line, as claimed in claim 37, wherein said means for controllably flattening said strip comprises means for controllably flattening said strip sufficiently, depending upon the gauge of the strip, to permit said mechanical descaling means to uniformly contact the surfaces of said strip.

39. A pickle line, as claimed in claim 37, wherein said mechanical descaling means comprises brushing means for abrading the oxide scale from the strip surface.

40. A pickle line, as claimed in claim 39, wherein said brushing means comprises at least two grinding brush roll assemblies arranged in series along the direction of strip travel, each assembly including a grinding brush roll and at least one backing roll opposing each other on opposite surfaces of the strip, the grinding brush roll being positioned alternately above and below the strip in adjacent assemblies and adapted to rotate in the direction counter to the direction of travel of the strip.

* * * * *